United States Patent [19]

Klenter et al.

[11] Patent Number: 4,884,690

[45] Date of Patent: Dec. 5, 1989

[54] END WALL OF MOLDABLE MATERIAL FOR A WOUND ROLL

[75] Inventors: Otto Klenter, Much; Klaus Burk, Overath-Vilkerath, both of Fed. Rep. of Germany

[73] Assignee: Hoechst Aktiengesellschaft, Frankfurt am Main, Fed. Rep. of Germany

[21] Appl. No.: 320,712

[22] Filed: Mar. 8, 1989

[30] Foreign Application Priority Data

Mar. 11, 1988 [DE] Fed. Rep. of Germany ..... 3808064

[51] Int. Cl.[4] ..... B65D 85/66

[52] U.S. Cl. ..... 206/416; 206/511

[58] Field of Search ..... 206/416, 415, 413, 414, 206/509, 511, 512

[56] References Cited

U.S. PATENT DOCUMENTS

| | | | |
|---|---|---|---|
| 3,606,002 | 9/1971 | Miller | 206/416 |
| 3,737,028 | 6/1973 | Carlson | 206/416 |
| 3,942,638 | 3/1976 | Stone | 206/416 |
| 4,398,653 | 8/1983 | Daloisio | 206/512 |
| 4,480,748 | 11/1984 | Wind | 206/511 |
| 4,690,345 | 9/1987 | Cotey | 206/416 |

FOREIGN PATENT DOCUMENTS

| | | |
|---|---|---|
| 1991976 | 5/1968 | Fed. Rep. of Germany . |
| 1486562 | 3/1969 | Fed. Rep. of Germany . |
| 1497929 | 1/1978 | United Kingdom . |

*Primary Examiner*—Joseph Man-Fu Moy

*Attorney, Agent, or Firm*—Foley & Lardner, Schwartz, Jeffery, Schwabb, Mack, Blumenthal & Evans

[57] ABSTRACT

An end wall comprises a plate having a smooth, plane fromt surface whereas its rear side is stiffened by radial ribs and annular ribs. A central insertion pin is provided on the front side of the plate. Each of the four side walls of the plate is equipped with stacking bosses limiting stacking pockets which are of complementary design to the stacking bosses. When vertically aligned end walls are being stacked side-by-side or one above the other, the stacking bosses and the stacking pockets of one side wall can be joined to the complementary stacking bosses and stacking pockets of a side wall of another end wall without a joint. Corner surfaces of the end wall are rounded off and provided with cylindrical locking bosses which have the same radius as the rounded corner surfaces.

8 Claims, 3 Drawing Sheets

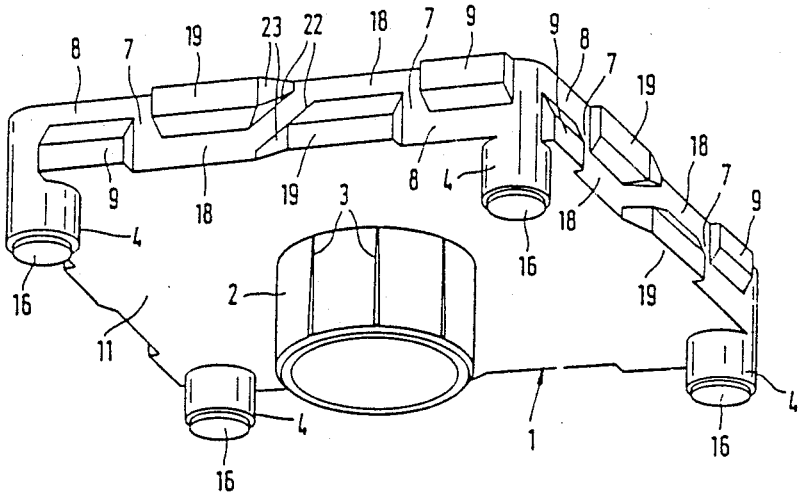
FIG. 2
FIG. 3
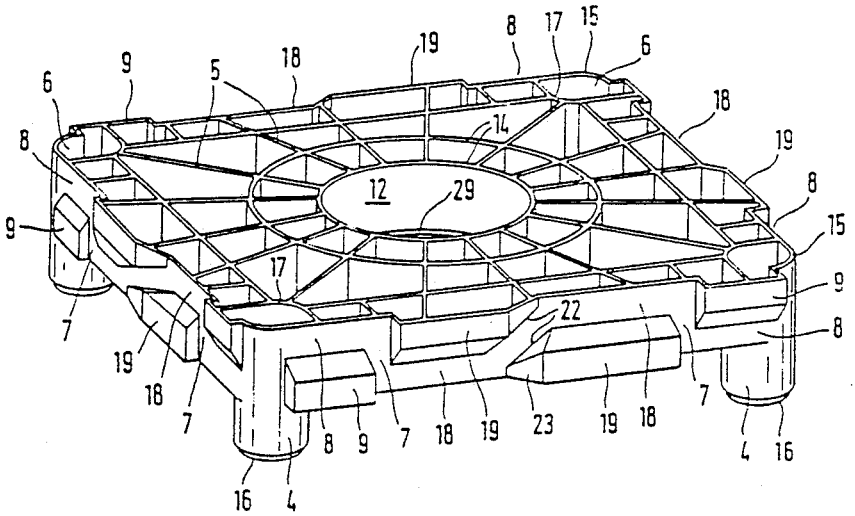

END WALL OF MOLDABLE MATERIAL FOR A WOUND ROLL

BACKGROUND OF THE INVENTION

The invention relates to an end wall of moldable material for a wound roll, having a rectangular, in particular square, plate which has rounded corner surfaces and the front side of which, said front side facing the wound roll, forms a smooth, flat surface and the rear side of which, said rear side facing outwards away from the wound roll, is stiffened by radial and annular ribs, having a central insertion peg and locking bosses on the front side of the plate.

Together with a second, corresponding end wall, an end wall of this kind, of plastic or some other moldable material, forms a rigid overall package for a wound roll, for packaging winding material, for example plastic films or sheets, wound onto take-up rolls.

The other, known packagings are in general constructed such that additional parts for the central fixing of the wound roll are placed in a box of wood or corrugated cardboard. These additional parts are, inter alia, wooden boards with hubs fitted, perforated discs of plywood, hardboard, greyboard having inserted centering bushes of sheet metal or plastic, or partially ribbed moldings of plastic having integrally molded receiving pegs.

A disadvantage of these known packagings is that they comprise a plurality of individual parts which, in addition, are not connected in a force-locking manner to one another. As a result, in the case of heavy wound rolls, the overall packaging has only low stability.

A disadvantage of the known end wall described at the outset is that, although it can be stacked together with further, horizontally oriented end walls, one above the other, thereby making possible space-saving storage of the end walls, the vertically oriented end walls cannot be stacked, by means of their side walls, in any desired manner next to each other or one above the other and brought into engagement and locked with respect to one another. This means that it is not readily possible to stack ready-packaged wound rolls one above the other by means of the end walls, since the stability of such a stack cannot be guaranteed.

German Utility Model 1,991,976 discloses a one-part end wall of plastic which comprises a quadrilateral, preferably square, flat plate stiffened by radial webs. In the center there is an insertion peg for the roll of winding material, said peg being equipped, for example, with retention prisms. The plate is surrounded by a belt, on the outside of which small prismatic strips are arranged. At the corners of the plate, the belt encloses four cup-shaped depressions which protrude into the free hollow space between the winding material and the packaging casing and are open near to the outer end face, and has a circumferential stop strip which is provided with teeth.

SUMMARY OF THE INVENTION

Accordingly, it is an object of the present invention to provide an improved end wall of the type described, so as to guarantee the mutual locking of the end walls of a plurality of complete rolls which are stacked one above the other and/or next to one another and are terminated by the end walls, the end walls being capable of mutual engagement with each of their side walls without the necessity of making a definite preselection of the orientation of the side walls with respect to one another.

In accomplishing the foregoing objectives, there has been provided, in accordance with one aspect of the present invention, an end wall of moldable material for a wound roll comprising a front side facing said roll and comprising a smooth flat surface, a central insertion plug and a plurality of locking bosses, a rear side facing outward and comprising a plurality of radial and annular ribs, whereby said rear side is stiffened, a plurality of rounded corner surfaces, and four side walls comprising a plurality of stacking bosses on the surfaces thereof, said stacking bosses limiting a plurality of stacking pockets of complementary design to said stacking bosses, whereby said stacking bosses and stacking pockets of each of said side walls are jointlessly connectable to the corresponding stacking pockets and stacking bosses, respectively, of any one of the four side walls of a second adjacently disposed end wall.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawing by which:

FIG. 2 represents a perspective view of the front side of the end wall in accordance with this invention, FIG. 3 represents a perspective view of the rear side of the end wall in accordance with this invention.

DETAILED DESCRIPTION OF THE PREFERRED EMBODIMENTS

In accomplishing this object in accordance with this invention, stacking bosses are provided at each of the four side walls of the plate, these stacking bosses limiting stacking pockets which are of complementary design to the stacking bosses, so that the stacking bosses and stacking pockets of any one of the side walls of an end wall can be jointlessly connected to any one of the four side walls of another end wall when a number of vertically aligned end walls are to be stacked side-by-side and/or to be piled up one above another.

In a further preferred embodiment of the invention, the cylindrical locking bosses integrated with the rounded corner surfaces of the end wall have the same radius as the rounded corner surfaces; each of the locking bosses merges into a cylindrical boss neck via a shoulder; when horizontally aligned end walls are being stacked vertically, the boss necks of the locking bosses of one end wall engage corresponding recesses provided in the rear side of the end wall being stacked upon it; and the recesses are adjacent to the hollow-cylindrical locking bosses, and are enclosed by the rounded corner surfaces and rounded webs.

In accordance with this invention, the stacking bosses have bevelled side faces which are inclined in the direction of the center line of the side wall. In alternating order, the stacking bosses are flush with the upper and the lower edges of the respective side wall.

The invention offers the advantage that the stacking bosses and stacking pockets of the end walls engage in one another in such a way that the complete wound rolls, which are bounded by the end walls and are stacked side-by-side or one above another, can no longer be displaced in the longitudinal or transverse direction. The bevelled side faces of the stacking bosses and stacking pockets permit stacking and unstacking of the wound rolls packaged using these end walls without problem.

Figure 1:
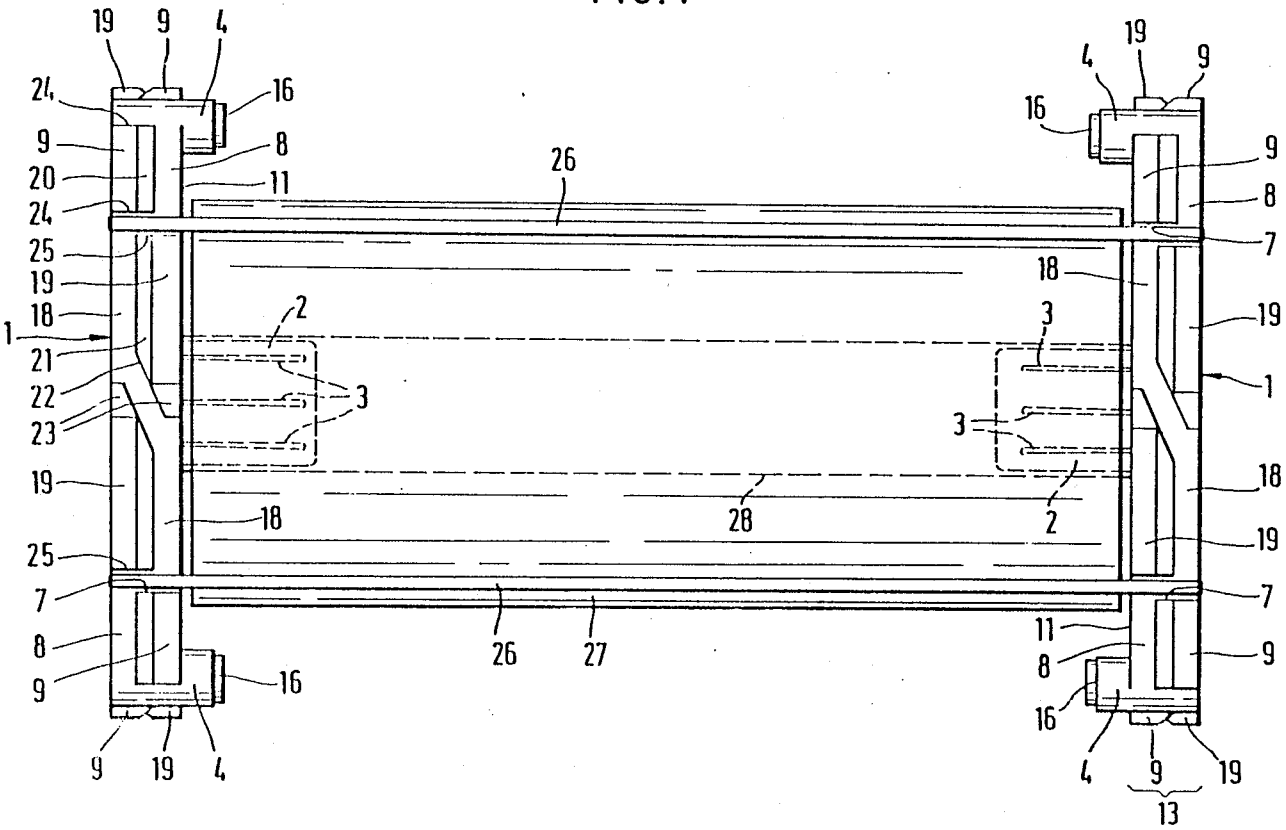
FIG. 1 represents a diagrammatic view of a wound roll wound onto a winding core bounded by end walls in accordance with this invention.

Referring to the drawing, a complete wound roll 27 which is wound onto a winding core 28 is represented schematically in FIG. 1. The end faces of the wound roll 27 are bounded by end walls 1, of which each has a central insertion peg 2 which is pushed into the winding core 28. The end wall 1 comprises a rectangular, in particular square, plate 11, at the four corners of which locking bosses 4 are arranged which merge into boss necks 16. Each of the four side walls 13 of the plate 11 of the end wall 1 is provided with stacking bosses 9, 19 of different lengths and cross-sections.

As can be seen from the perspective view of the front side of the end wall 1 in FIG. 2, corner surfaces 15 of the end wall 1 are rounded off, and the cylindrical locking bosses 4 are integrated with these rounded corner surfaces 15 and have the same radii as the latter. The cylindrical boss necks 16 are set off from the locking bosses 4 by a shoulder and have a smaller diameter than the locking bosses. The smooth or plane front side of the plate 11, which faces the wound roll, protects the end face of the wound roll, in particular during transportation, against damage.

V-shaped ridges 3 extend parallel to the longitudinal axis of the insertion peg 2 on the outer surface of the insertion peg 2, said ridges having a V-shaped cross-section which becomes smaller towards the front side of the plate 11. The insertion peg 2 is pressed into the bore of the winding core 28 (see FIG. 1). The V-shaped ridges 3 on the insertion peg 2 guarantee a better grip of the insertion peg in the winding core 28 and compensate for dimensional tolerances of the winding core on the one hand and of the insertion peg on the other. The diameter of the hollow cylindrical insertion peg 2 is matched to the diameter of the respective bore of the winding core 28.

From the perspective view in FIG. 3 of the rear side of the end wall 1, which faces outwards and away from the wound roll, it can be seen that the end wall 1 is equipped with radial ribs 5 and annular ribs 14, which stiffen the rear side and avoid large wall thicknesses, with the result that the weight of the end wall 1 can be kept low. As a result of these ribs, the end wall 1 has a high load-bearing capacity while having a low overall weight.

As can be seen from FIGS. 1 and 2, the stacking bosses 9 and 19 limit stacking pockets 8, 18, which are of complementary design to the stacking bosses. The stacking bosses 9 are shorter than the stacking bosses 19. The basic design of the two groups of stacking bosses 9, 19 is in each case cuboid, the one side face 20, 21 of the stacking boss 9, 19 being bevelled and inclined towards the side wall 13. One stacking boss 9 is in each case arranged near to the round corner surface 15 of the side wall 13, the one stacking boss 9 being of a design such that it is rotated by 180° with respect to the other stacking boss 9 and offset diagonally with respect to the other stacking boss 9. The two other stacking bosses 19 of a side wall 13 are also rotated by 180° with respect to one another and are mutually offset diagonally, as will be described in greater detail below. One stacking boss 9 and 19 in each case is flush, for example, with the lower edge of the side wall 13, while the stacking bosses 19 and 9, rotated by 180° thereto, are flush with the upper edge of the side wall 13.

In addition to the bevelled side face 21, the group consisting of the longer stacking bosses 19 has oblique surfaces 22, 23. The mutually opposing stacking bosses 19, 19, which are rotated by 180° with respect to one another, are arranged in such a way that the oblique surfaces 22, 23, lying diagonally opposite one another, overlap. By virtue of the oblique surfaces 22, 23, one end face of the stacking bosses 19 runs to a point wedge-fashion, while the end face 25 of the respective stacking boss 19, said end face lying opposite to these oblique surfaces 22, 23, extends perpendicular to the side wall 13. The group comprising the shorter stacking bosses 9 has two end faces 24 per stacking boss, said end faces extending perpendicular to the side wall 13. The mutually opposing, spaced end faces 24, 25, of the stacking bosses 9, 19, in each case form the limiting walls for a guide groove 7 which accommodates a strap 26 (see FIG. 1) of the wound roll 27.

There are at least two guide grooves 7 on each of the four side walls 13, said guide grooves being, for example, 20 mm wide and about 10 mm deep.

The two end walls 1 of a wound roll are connected firmly to the wound roll by strapping with two straps 26 of plastic or metal. The exact mutual spacing of the guide grooves 7 is selected in such a way that the straps can be applied by a tandem strapping installation. If necessary, the end wall edges can be reinforced at the strapping locations and the guide grooves be provided with the appropriate strength by means of an opposite end wall rib.

The radial ribs 5 and the annular ribs 14 on the rear side of the plate 11 are on the same level as the outer rims or edges of the side walls 13 of the plate 11. In the exemplary embodiment described, two stacking bosses 9 and two stacking bosses 19 are in each case provided per side wall 13. At dimensions of 425 mm×425 mm of the end wall 1, for example, this number of stacking bosses is sufficient, but it is obvious that, in the case of larger end wall dimensions, for example of 580 mm×580 mm or more, a correspondingly larger number of stacking bosses 9 and 19 would have to be present per side wall. The number of guide grooves 7 would then also be greater than two.

As can be seen from FIG. 3, the plate 11 possesses a central cylindrical through-opening 12. The hollow cylindrical insertion peg 2 is connected to this central cylindrical through-opening 12 via a shoulder 29. The diameter of the through-opening 12 is greater than the outside diameter of the insertion peg 2. The rear side of the plate 11 is provided with recesses 6 which are enclosed by the rounded corner surfaces 15 and rounded webs 17. The hollow-cylindrical locking bosses 4 are directly above the recesses 6.

If two horizontally aligned end walls 1 are stacked one above the other, the boss necks 16 of the locking bosses 4 of one end wall engage in the recesses 6 on the rear side of the plate 11 of the end wall lying thereabove. The insertion peg 2 likewise engages in the through-opening 12, thereby producing the possibility of stacking and palletizing the end walls in a space-saving manner.

Figure 4:
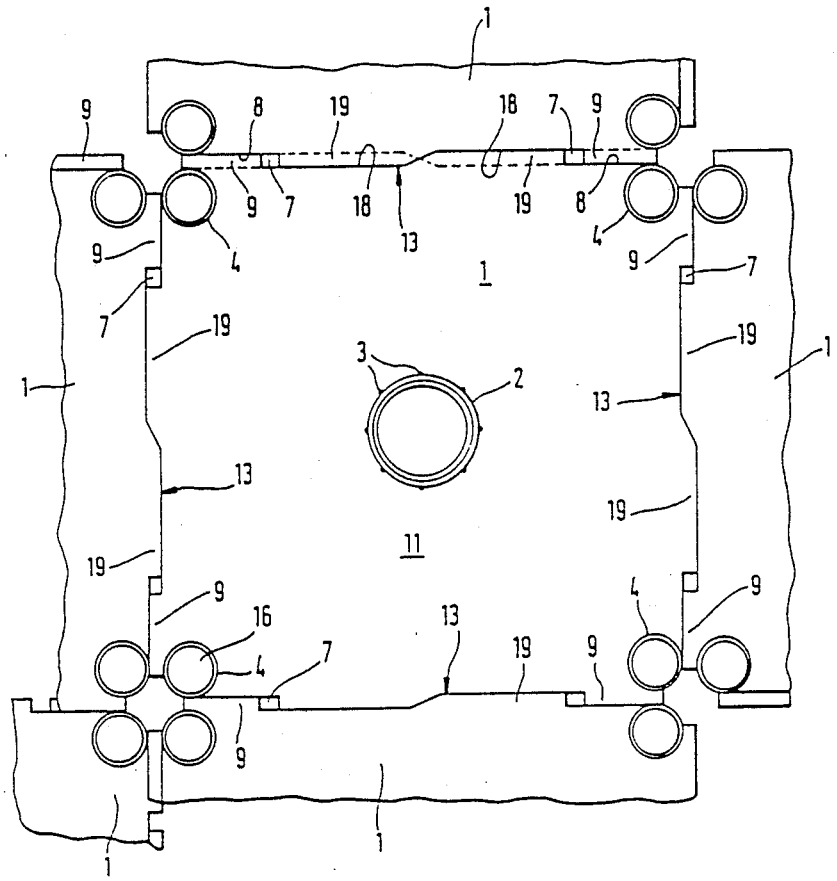
FIG. 4 represents a diagrammatic view of end walls stacked side-by-side and above one another, with a central end wall, the four side walls of which are in engagement with one side wall each of four other end walls.

FIG. 4 shows a diagrammatic view of a plurality of end walls 1 which are stacked both side-by-side and one above the other. Thereby, each of the four side walls of a central end wall 1 is in engagement with a corresponding side wall of one of four other end walls. Since, as mentioned above, the stacking pockets 8 and 18 are of a design complementary to the stacking bosses 9, 19, it is possible, when stacking laterally together or next to one another and/or when stacking the vertically oriented end walls 1 vertically one above the other, for the stacking bosses 9, 19 and the stacking pockets 8, 18 of one side wall 13 of an end wall to be fitted together without a gap with the complementary stacking pockets 8, 18 and the complementary stacking bosses 9, 19 of each of the four side walls 13 of the other end walls 1.

The stacking bosses or stacking pockets engage in one another in such a way that a displacement lengthwise or transversely to the sidewall 13 is not possible. The bevelled side faces of the stacking bosses and of the stacking pockets permit problem-free stacking and unstacking of the wound rolls packaged using these end walls. Mutual locking of the complete wound rolls packaged by means of the end walls and stacked one above the other or next to one another is achieved.

The end walls 1 are produced, for example, from thermoplastic plastics by injection molding. Here it is possible to use reclaims and recycling materials.

Thereby, the webs and ribs as well as the stacking bosses are formed in one single injection molding operation.

Since all four side walls 13 o an end wall 1 are of identical design with respect to the stacking bosses and stacking pockets, it is possible at any time to stack the wound rolls terminated by the end walls laterally next to one another and/or one above the other, since each side wall of one end wall can be brought into engagement with each side wall of another end wall without the necessity for a preferred orientation of the end walls with respect to one another. In other words, this means that the stacking bosses and stacking pockets engage in, or snap into, each other in all positions of the end walls, whether vertically or horizontally oriented. Another advantage is that tee individual vertically oriented end wall can be conveyed without problems on roller conveyors having a roller spacing of from 60 to 80 mm, since the top surfaces of the stacking bosses 9, 19 of the individual side walls 13 lie in the same plane and furthermore have a maximum mutual spacing of 20 mm.

What is claimed is:

1. An end wall of moldable material for a wound roll comprising a rectangular plate which comprises a front side facing said roll and comprising a smooth flat surface, a central insertion plug and a plurality of locking bosses, a rear side facing outward and comprising a plurality of radial and annular ribs, whereby said rear side is stiffened, a plurality of rounded corner surfaces, and four side walls comprising a plurality of stacking bosses on the surfaces thereof, said stacking bosses limiting a plurality of stacking pockets of complementary design to said stacking bosses, whereby said stacking bosses and stacking pockets of each of said side walls are jointlessly connectable to the corresponding stacking pockets and stacking bosses, respectively, of any one of the four side walls of a second adjacently disposed end wall.

2. The end wall as claimed in claim 1, wherein said locking bosses on said front side are hollow and cylindrical, integrated with said round corner surfaces, have the same radius as said round corner surfaces and merge into a cylindrical boss neck via a shoulder, and said rear side has a plurality of recesses therein corresponding to the hollow interior of each said locking boss and merging thereinto, said recesses being limited by said rounded corner surfaces and by rounded webs on said rear side, whereby said end wall is stackably joinable to horizontally aligned upper and lower end walls such that the boss neck of each locking boss of each said end wall engages the corresponding recess of the end wall stacked above it.

3. The end wall as claimed in claim 1, wherein said stacking bosses have bevelled side faces which are inclined towards said side walls, and wherein a pair of stacking bosses lie flush with the upper edge and the lower edge respectively of each said side wall.

4. The end wall as claimed in claim 3, wherein one group of said stacking bosses has a different length and possesses additional oblique surfaces as compared to the other group of said stacking bosses, and wherein one shorter stacking boss is in each case arranged near to one of the two corner surfaces of each said side wall, the two shorter stacking bosses being rotated by 180° with respect to one another and wherein the two longer stacking bosses are also rotated by 180° with respect to one another and offset with respect to one another, with their diagonally opposing oblique surfaces overlapping.

5. The end wall as claimed in claim 4, wherein the mutually opposing, spaced end faces of said stacking bosses extend perpendicularly to said side wall, forming a guide groove for a strap whereby said wound roll is secured.

6. The end wall as claimed in claim 1, wherein said insertion peg is hollow and cylindrical and is connected via a shoulder to a central, cylindrical through-opening on the rear side of said plate, and wherein the diameter of said through-opening is greater than the outside diameter of said insertion peg.

7. The end wall as claimed in claim 6, wherein a plurality of V-shaped ridges extend parallel to the longitudinal axis of said insertion peg on the outer surface of said insertion peg, said ridges having a cross-section which becomes smaller towards the front side of said plate.

8. The end wall as claimed in claim 1, wherein said plate is square.

* * * * *